US005417231A

United States Patent [19]

Frederiksen

[11] Patent Number: 5,417,231

[45] Date of Patent: May 23, 1995

[54] APPARATUS FOR DEGREASING OBJECTS

[76] Inventor: Henning Frederiksen, Radbyvej 66, DK-5320 Agedrup, Denmark

[21] Appl. No.: 167,992

[22] PCT Filed: Jun. 29, 1992

[86] PCT No.: PCT/DK92/00207

§ 371 Date: Dec. 23, 1993

§ 102(e) Date: Dec. 23, 1993

[87] PCT Pub. No.: WO93/00176

PCT Pub. Date: Jan. 7, 1993

[30] Foreign Application Priority Data

Jun. 27, 1991 [DK] Denmark ..... 1260/91

[51] Int. Cl.[6] ..... B08B 3/02

[52] U.S. Cl. ..... 134/65; 134/111; 134/132; 68/242

[58] Field of Search ..... 134/132, 65, 111, 201; 68/58, 242

[56] References Cited

U.S. PATENT DOCUMENTS

| | | | |
|---|---|---|---|
| 710,422 | 10/1902 | Butler et al. | 134/132 |
| 794,824 | 9/1905 | Baenen | 134/65 |
| 1,251,073 | 12/1917 | Maloney | 134/132 X |
| 2,089,102 | 8/1937 | Savage | 134/65 X |
| 2,612,178 | 9/1952 | Skinner | 134/132 |
| 2,909,872 | 10/1959 | Kearney et al. | 134/132 |
| 3,117,031 | 1/1964 | Griffiths | 134/132 |

*Primary Examiner*—Frankie L. Stinson
*Attorney, Agent, or Firm*—Antonelli, Terry, Stout & Kraus

[57] ABSTRACT

Apparatus (2) for degreasing of objects and with a mainly horizontal rotating drum (4) with an outer perforated tube (6) with at least one interior spiral (12) for guiding objects to be degreased, and with transportation means of the impeller type for liquid washing and rinsing agents, as the drum (4) is divided in at least two zones, respectively a washing (20) and a rinsing zone (22) and possibly a drying zone, the drum (4) consists of three concentric tubes in the form of said outer tube (6) of perforated plates or netting, an inner tube (8) and an inmost, central heating tube (10), through which hot air is lead to the inner tube (8) via radial nozzle openings (11), and between the outer (6) and inner tube (8) a spiral member (12) is placed, adapted to move the objects forward in the drum (4) passing the washing and rinsing zones (20, 22), while between the inner tube (8) and the inmost heating tube (10) an inverted twisted, inner spiral (18) is placed, adapted to move the objects back through the drum (4), as the objects after the rinsing zone are lead from the outer perforated tube (6) upwards and inwards into the inner tube (8).

6 Claims, 3 Drawing Sheets

FIG. 1
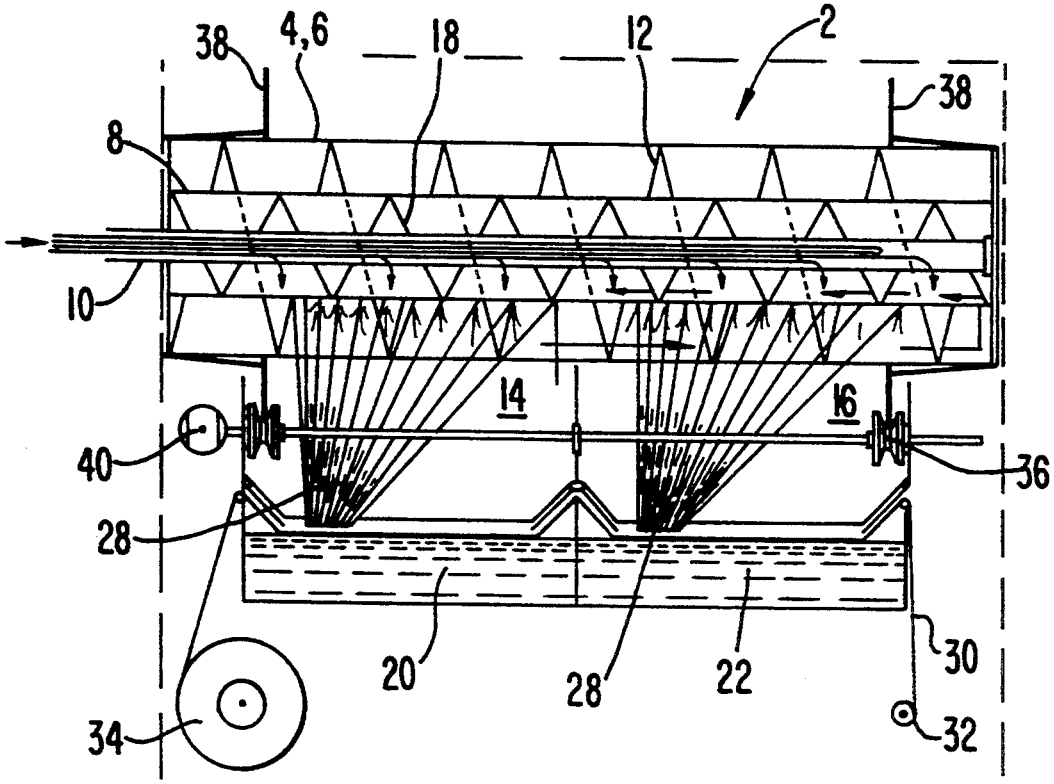
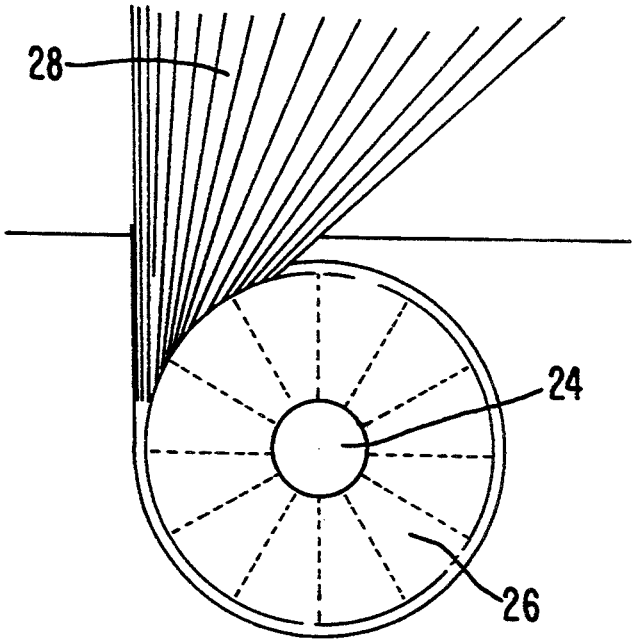
FIG. 2

APPARATUS FOR DEGREASING OBJECTS

BACKGROUND OF THE INVENTION

The present invention relates to an apparatus for degreasing objects.

From DE-A1 23 04 524 a drum washing apparatus intended for washing, rinsing and drying of metal objects is known. This apparatus consists of a long, inclined drum, which possibly is divided in several cascade-coupled drum sections, and which are provided with a single twisted spiral for moving objects. The objects are lead in in one end of the drum, conveyed through a washing zone, to which washing agent is supplied via a nozzle tube inside the washing zone, followed by a draining zone. Herefrom dirty washing agent is lead to a collecting container, where the washing agent possibly is cleaned and lead back to the supply container for reuse. The objects continue through a rinsing zone with a belonging draining zone, and the rinsing process may be completed by leading out the objects through a drying zone at the opposite end of the drum washing apparatus.

SUMMARY OF THE INVENTION

The invention has for its purpose to provide an apparatus of the type described in the introductory part, and which by simple provisions may appear as an extremely compact apparatus, which as an independent unit in particular is suitable for use at decentralized degreasing of objects.

The apparatus according to the invention is distinctive in that the drum consists of three concentric tubes in the form of said outer tube of perforated plates or netting, an inner tube and an inmost, central heating tube, through which hot air is lead to the inner tube via radial nozzle openings, that the drum between the outer and inner tube comprises a spiral member adapted to move the objects forward in the drum passing the washing and rinsing zones, and that the drum between the inner tube and the inmost heating tube comprises an inverted twisted, inner spiral, adapted to move the objects back through the drum, as the objects after the rinsing zone are lead from the outer perforated tube upwards and inwards into the inner tube.

By the placement of washing and rinsing zones immediate after each other, and because the drying zone is placed along the middle of the drum, that is along the inner, opposite twisted spiral, a simple and compact apparatus is primarily obtained, which furthermore has following advantages:

- short and compact apparatus, easy to move for decentralized degreasing operations, for instance directly at groups of lathe apparatuses,
- the inner tube is heated by the hot, drying air, which is blowed in via radial air nozzles in central heating tube, that is that washing and rinsing agents passing the objects hit the outer side of the inner tube and are heated,
- between the outer perforated tube and spiral a suitable filter web may be placed for object dimensions down to very small objects,
- or the whole drum as a loose unity may be replaced,
- washing and rinsing agents are sprayed from outside through the outer perforated tube, so that the objects being conveyed forward and being rolled around inside the big, outer spiral are effectively sluiced,
- in proportion to known technique a very effective washing, rinsing and drying process is obtained,
- good working economy by good exploitation of supplied energy, and low environmental taxes—only 2×8 liters of washing and rinsing agents are used,
- infinitely variable control of drum and impeller pump.

Appropriately the apparatus according to the invention is such provided that impellers for spraying washing and rinsing agents, respectively, are placed under the drum and at a side of separate supply container for washing and rinsing agents, that a sheet formed filter is arranged between the supply container and the drum, which filter the washing and rinsing agents have to pass, when lead back to the containers.

Preferably the apparatus is such provided that the sheet formed filter stretches from one supply roll at a rearside end of the apparatus to a spooling roll or mechanism at the opposite end of the apparatus, that is so that the filter sheet, which has been used between supply container and rinsing zone, subsequently may be reused between the supply containers and the washing zone.

In order to achieve best possible utilization of the hot drying air for heating of the washing and the rinsing agents, the apparatus preferably is such provided that the central heating tube is stationary, that is not rotating together with the drum, and that the radial nozzle openings for the hot drying air are placed in the lower side of the heating tube and preferably opposite the fan-shaped jets of washing or rinsing agents from the respective impellers.

And preferably the central heating tube is connected with a fan heater, preferably placed at a rearside end of the apparatus.

BRIEF DESCRIPTION OF THE DRAWINGS

The invention is described in the following with reference to the drawing, in which:

FIG. 1 is a schematic showing an embodiment for an apparatus according to the invention, FIG. 2 shows the impeller principle used by the apparatus, FIG. 3, according to the invention, FIG. 5 shows a detail view of a preferred embodiment for a drum to the apparatus according to the invention, while

Figure 3:
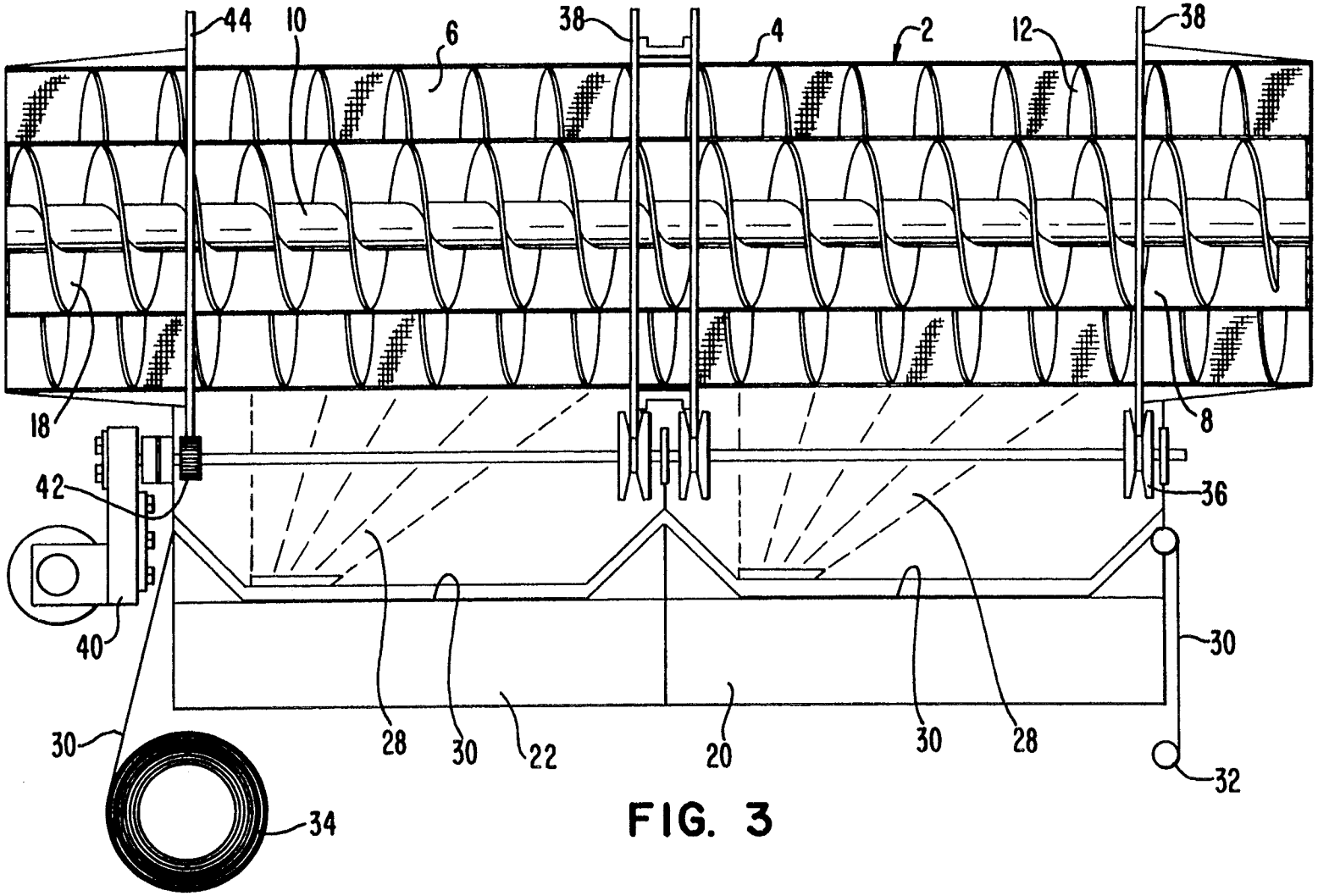
FIG. 3 shows a side view—partly in section—of a preferred embodiment for an apparatus according to the invention.

The degreasing apparatus 2 shown in FIGS. 1 and 3 comprises a horizontal rotating drum 4 consisting of three concentric tubes, namely an outer tube 6 of perforated plate or netting, an inner tube 8 of thin plate of stainless steel and, and inmost, central heating tube 10, also manufactured of thin plate of stainless steel and provided with radial nozzle openings 11.

Between the outer tube 6 and the inner tube 8 a spiral (worm) 12 adapted to convey the degreasing objects forward in the drum 4 passing a washing zone 14 and a rinsing zone 16. Between the inner tube 8 and the inmost heating tube 10 an opposite twisted spiral 18 is placed being adapted to move the degreasing objects back through the drum 4, this means that both the feed in and the removal of degreasing objects are effected from the very same end of the apparatus 2 (at the left handside of FIGS. 1 and 3).

Figure 4:
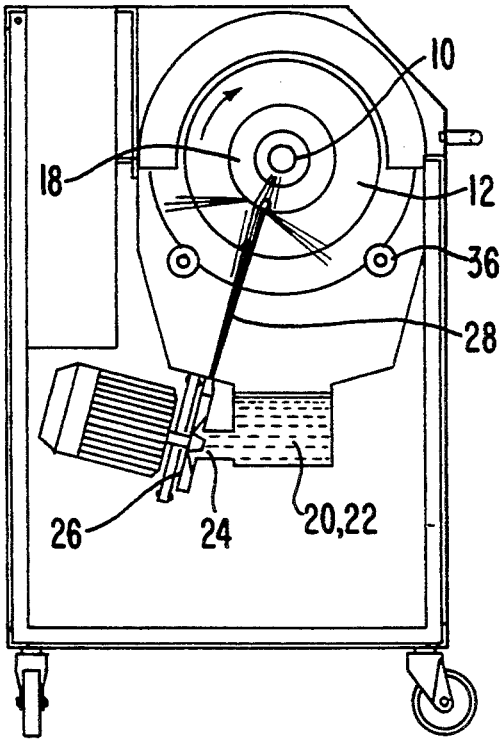
FIG. 4 shows an end view—partly in section—of an apparatus, cf.
Figure 5:
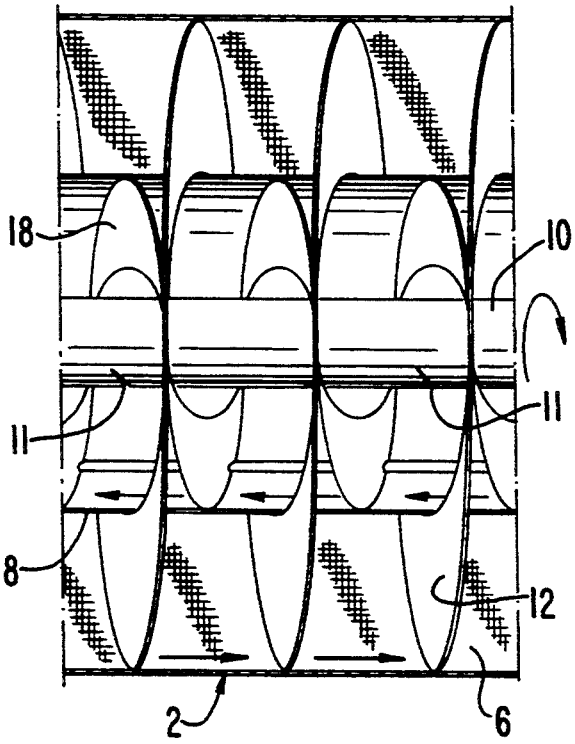
Figure 6:
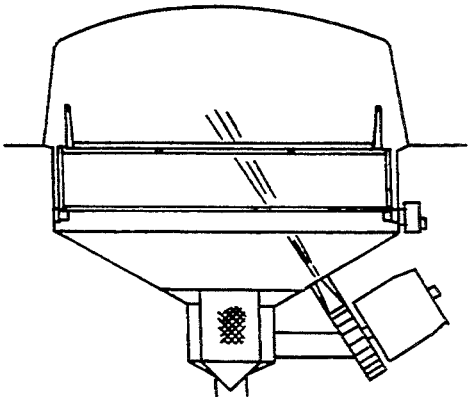
FIG. 6 shows an alternative apparatus.

Under the washing zone 14 and the rinsing zone 16, respectively, separate supply containers 20 and 22 for washing and rinsing agents are placed. Via side channels 24 washing and rinsing agents are lead into a central opening of fast rotating impeller 26 and therefrom is sprayed in a powerful fan-shaped jet 28 (FIGS. 2 and 4) up through the perforated outer side of the outer tube 6 and sluices the objects and the outer side of the inner tube 8, that is that the objects at rotation of the drum 4 and by means of the spiral 12 are conveyed and being rolled forward through the washing zone 14 and the rinsing zone 16, respectively, being effectively sluiced from several sides, because the washing and rinsing agents are also reflected from the outer side of the inner tube 8. In FIGS. 1 and 3, where the powerful fan-shaped jets 28 of washing and rinsing agents may be seen from the side, it is also seen, that the fan-shape of the jets 28 for sluicing of the respective zone most effective in the whole length are asymmetrical with a straight and an inclined side flange, respectively.

It shall be mentioned, that the impeller 26 for the washing zone 14 in practice preferably is placed close to the passage to the rinsing zone 16, that is so that the straight side flange of the fan-shaped jet 28 faces the rinsing zone 16 and the inclined side flange faces the left handside, that is towards the front end of the drum 4, as in this manner it is easier to avoid to mix washing and rinsing agents.

Washing and rinsing agents are lead from the drum 4 and collected in the supply containers 20 and 22, as the washing and the rinsing agents on the way back are passing a filter path 30, which from a supply roll 32 possibly supported on a not shown strainer plate is lead over the respective supply containers 20 and 22, and which after use are spooled on a collecting roll 34. That is, that the filter path 30 is first used as filter between the rinsing zone 16 and the supply container 22 and afterwards may be reused as filter between the washing zone 14 and the supply container 20.

The drum 3 is as a separate unit supported on carrier rollers 36 by means of radial support flanges 38; and the drum 4 is rotated by means of a gear motor 40 via pinion 42 and radial toothed rim 44. The impellers 26 for washing and rinsing zones are driven by individual drive motors 46. That is, that both the number of revolutions of the drum and speed of the impeller 26 may be controlled infinitely variable for optimizing in accordance to actual rinsing purpose.

I claim:

1. Apparatus for degreasing objects comprising a mainly horizontal rotating drum with an outer perforated tube with at least one interior spiral for guiding objects to be degreased, and an impeller type transportation means for liquid washing and rinsing agents, wherein the drum is divided in at least two zones including a washing and a rinsing zone wherein the drum consists of three concentric tubes in the form of an outer tube of perforated plates or netting, an inner tube and an inmost central heating tube, through which hot air is lead to the inner tube via radial nozzle openings, wherein the drum between the outer and inner tube comprises a spiral member adapted to move the objects forward in the drum passing the washing and rinsing zones, and wherein the drum between the inner tube and the inmost heating tube comprises an inverted twisted inner spiral adapted to move the objects back through the drum, as the objects after the rinsing zone are lead from the outer perforated tube upwards and inwards into the inner tube.

2. Apparatus according to claim 1, wherein impellers for spraying washing and rinsing agents, respectively, are placed under the drum and at a side of separate supply containers for washing and rinsing agents and wherein a sheet formed filter is arranged between the supply container and the drum, wherein the washing and rinsing agents pass through the sheet formed filter when lead back to the containers.

3. Apparatus according to claim 2, wherein the sheet formed filter stretches from one supply roll at a rearside end of the apparatus to a spooling roll or mechanism at an opposite end of the apparatus, such that the sheet formed filter can be first used between the supply container and rinsing zone, and subsequently reused between the supply containers and the washing zone.

4. Apparatus according to claim 1, wherein the central heating tube is stationary such that it does not rotate together with the drum, and wherein the radial nozzle openings for the hot air are placed in a lower side of the heating tube and opposite fan-shaped jets of washing or rinsing agents from the respective impellers.

5. Apparatus according to claim 4, wherein the central heating tube is connected with a fan heater provided at a rearside end of the apparatus.

6. Apparatus according to claim 1, wherein the drum is divided into three zones including said washing zone, said rinsing zone and a drying zone.

* * * * *